US009540876B2

(12) United States Patent
Walsh

(10) Patent No.: US 9,540,876 B2
(45) Date of Patent: Jan. 10, 2017

(54) LADDER LEVELLING STABILIZER

(71) Applicant: Branach Technology Pty Ltd, Boronia, Victoria (AU)

(72) Inventor: Michael Walsh, Victoria (AU)

(73) Assignee: Branach Technology Pty Ltd, Boronia (AU)

( * ) Notice: Subject to any disclaimer, the term of this patent is extended or adjusted under 35 U.S.C. 154(b) by 0 days.

(21) Appl. No.: 14/426,276

(22) PCT Filed: Sep. 5, 2013

(86) PCT No.: PCT/AU2013/001011

§ 371 (c)(1),
(2) Date: Mar. 5, 2015

(87) PCT Pub. No.: WO2014/036606

PCT Pub. Date: Mar. 13, 2014

(65) Prior Publication Data

US 2015/0252620 A1 Sep. 10, 2015

(30) Foreign Application Priority Data

Sep. 5, 2012 (AU) ..... 2012903863

(51) Int. Cl.
*E06C 7/42* (2006.01)
*E06C 7/44* (2006.01)

(52) U.S. Cl.
CPC ..... *E06C 7/423* (2013.01); *E06C 7/426* (2013.01); *E06C 7/44* (2013.01)

(58) Field of Classification Search
CPC ..... E06C 7/42; E06C 7/423; E06C 7/44; E06C 7/426
See application file for complete search history.

(56) References Cited

U.S. PATENT DOCUMENTS

| | | | | | |
|---|---|---|---|---|---|
| 1,442,694 | A | * | 1/1923 | Weaver | 182/200 |
| 2,552,941 | A | * | 5/1951 | Russel | 182/202 |
| 3,012,628 | A | * | 12/1961 | Zumbaum | 182/172 |
| 4,519,477 | A | * | 5/1985 | Ralston | 182/107 |
| 4,964,488 | A | * | 10/1990 | Stewart | 182/172 |

(Continued)

FOREIGN PATENT DOCUMENTS

| | | |
|---|---|---|
| CA | 2543948 | 10/2007 |
| DE | 10110405 | 9/2002 |

(Continued)

OTHER PUBLICATIONS

International Search Report for PCT/AU2013/001011 dated Oct. 23, 2013 (3 pages).

*Primary Examiner* — Charles A Fox
*Assistant Examiner* — Kristine Florio
(74) *Attorney, Agent, or Firm* — Michael Best & Friedrich LLP

(57) ABSTRACT

A levelling stabilizer for a ladder and the like comprising a transverse brace (1) adapted for bridging the bottom stiles (2) of said ladder, two leg portions (3) pivotally fitted to said brace and an adjustment arm (7) acting between said brace and said leg portions to allow each said leg portion to be independently moved between a first fully retracted position aligned longitudinally with its respective stile and a second fully extended position at an angle normal to said stile.

14 Claims, 12 Drawing Sheets

(56) References Cited

U.S. PATENT DOCUMENTS

| | | | | |
|---|---|---|---|---|
| 5,086,876 | A * | 2/1992 | Severson | 182/172 |
| 6,997,283 | B2 | 2/2006 | Wollenberg et al. | |
| 7,093,690 | B2 | 8/2006 | Swann | |
| 7,216,742 | B2 * | 5/2007 | Spengler | 182/172 |
| 8,251,180 | B1 | 8/2012 | Paige | |
| 2009/0107765 | A1 * | 4/2009 | Germond | 182/172 |
| 2010/0147623 | A1 * | 6/2010 | Pocos | 182/107 |
| 2014/0020981 | A1 * | 1/2014 | Burden | 182/201 |
| 2014/0131541 | A1 * | 5/2014 | Polzen | 248/354.6 |

FOREIGN PATENT DOCUMENTS

| | | | |
|---|---|---|---|
| GB | 2099060 | A | 5/1981 |
| GB | 2483692 | | 3/2012 |
| JP | 2001248374 | | 9/2001 |
| SE | 0900540 | A1 | 10/2010 |

* cited by examiner

LADDER LEVELLING STABILIZER

BACKGROUND AND INTRODUCTION TO INVENTION

This invention relates to a stabilizing device for use on ladders and similar apparatus where the positioning of such apparatus on unlevel or unstable ground often results in compromised security and safety of such devices, with leveling often being improvised by a range of adhoc measures generally resulting in highly unstable and unsatisfactory positioning and securing of ladders and similar devices.

In addition the footprint available for most ladders is limited due to the practical construction constraints of such devices resulting in inherent limitations to the stability and security of ladders due to this restricted footprint.

It would be desirable to provide an accessory for use on existing ladders or the like or alternatively a device adapted for incorporation in the original design of a ladder to provide the ability for stabilising the ladder on uneven ground and in addition providing an increased footprint for the ladder or similar device.

One object of the invention is to provide an improved levelling stabilizer for ladders and the like.

STATEMENT OF INVENTION

In a first aspect the invention provides a levelling stabilizer for a ladder or similar device comprising a transverse brace adapted for bridging the bottom stiles of the ladder, two leg portions pivotally fitted to the brace and an adjustment arm acting between the brace and the leg portions so as to allow each leg portion to be independently moved between a first fully retracted position being aligned longitudinally with its respective stile and a second fully extended position at an angle normal to said stile extending outwardly from the footprint of the ladder.

The levelling stabilizer most preferably includes a rotatable adjustment arm with the adjustment arm including a threaded portion which is adapted to co-operate with its respective leg portion such that the adjustment arm resists movement of the leg portion when in the second extended position except by rotation of the treaded portion.

The adjustment arm may also include a non-threaded portion incorporating a stop at the terminal end thereof with the non-threading portion cooperating with the transverse brace of the stabilizer so as to allow movement of the leg between the first retracted and second extended positions with the stop limiting extension of the second position.

The adjustment arm may also include a thumb screw to assist in the rotation thereof so as to effect the adjustment by controlling the degree of extension of the leg relative to the transverse brace.

The transverse brace may incorporate an adjustment housing suspending from the lower side thereof adapted to house the adjustment mechanics including the non-threaded portion of the adjustment arm.

The adjustment housing most preferably includes a pivotably mounted receiving bush which is adapted to co-operate with a non-threaded portion of the adjustment arm by way of telescopic engagement and co-operation with the non-threaded portion moving in and out of the receiving bush.

The stop most preferably co-operates with the receiving bush to limit the available extension.

The leg portion of the stabilizer preferably includes a pivoting captive nut adapted to co-operate with the treaded portion of the adjustment arm in a similar manner to that of the receiving bush cooperating with a non-threaded portion.

The levelling stabilizer most preferably further includes a floating interference member positioned within the adjustment housing and being movable between a first raised position accommodating the withdrawn non-treaded portions of the adjustment arms during the retracted leg portion position and the second lowered position intersecting the adjustment arm stops during the extended leg portion position and preventing retraction thereof.

The interference member preferably includes a visual indicator of the first and second positions.

The levelling stabilizer may also include a retraction lock adapted to retain the leg portions in the retracted position.

The retraction lock most preferably co-operates with the stop of the non-threaded portion of the withdrawn adjustment arm so as to retain the leg portion in the retracted position.

DETAILED DESCRIPTION OF THE INVENTION

The invention will now be described with reference to one particularly preferred embodiment being the levelling stabilizer incorporated with an extension ladder as shown with reference to FIGS. 1-6 and the accompanying legend.

Figure 7:
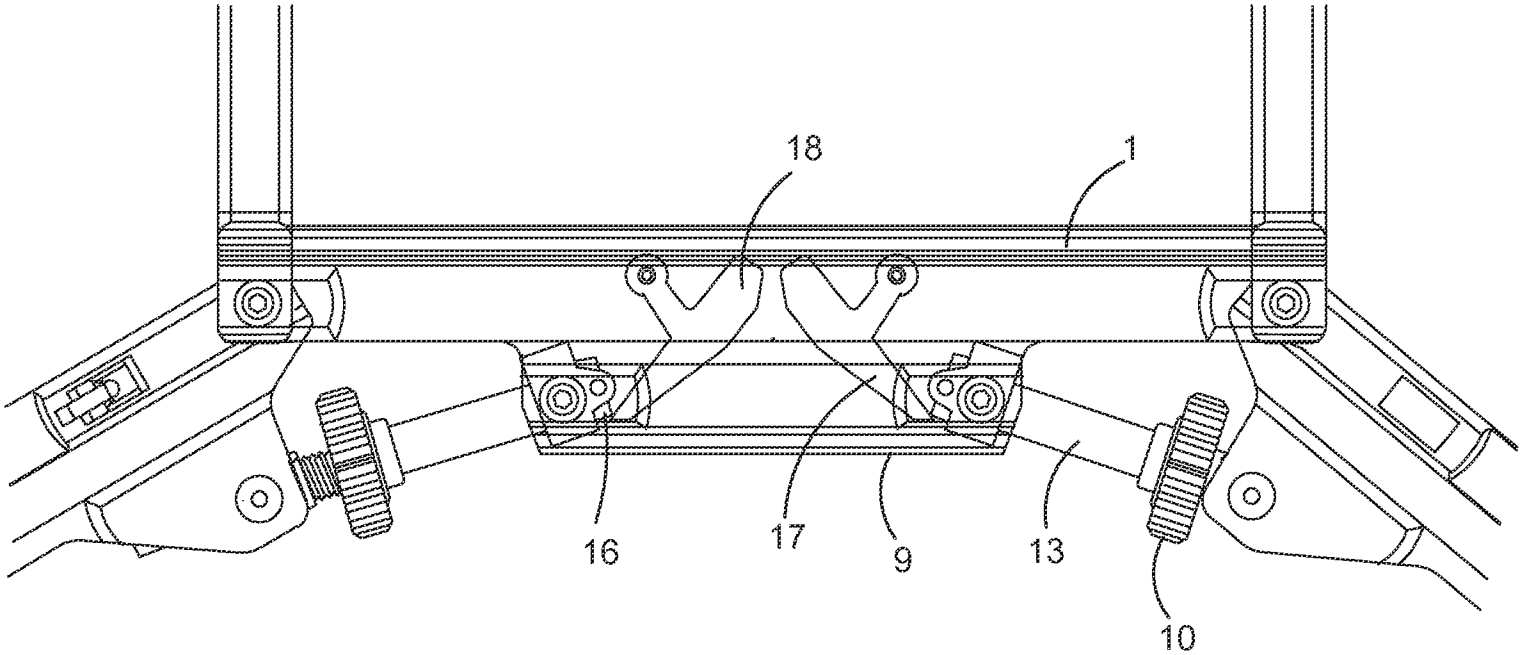

FIGS. 7/8 show an alternative embodiment of visual indictator.

Figure 9A:
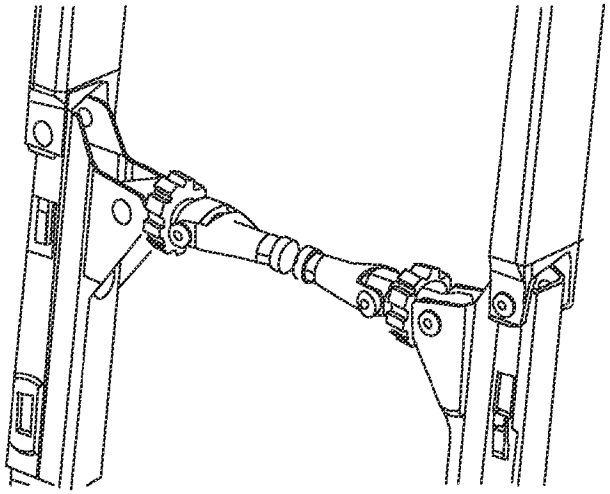
Figure 9B:
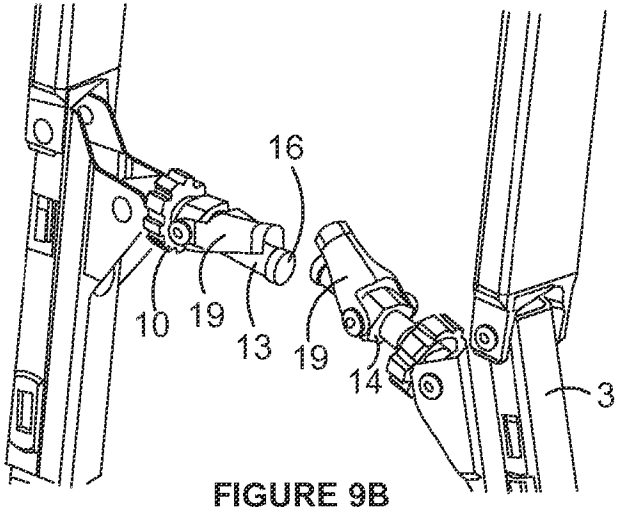
Figure 9C:
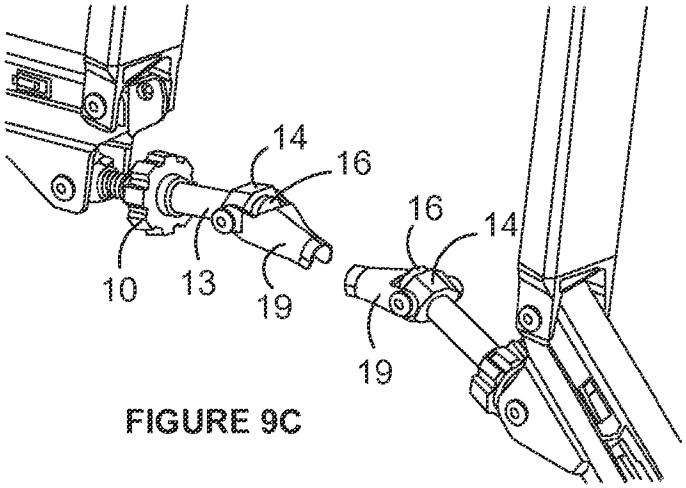

FIGS. 9A-9C/10A-10C show a lock to retain the levelling stabilizer legs in the retracted position.

Figure 11A:
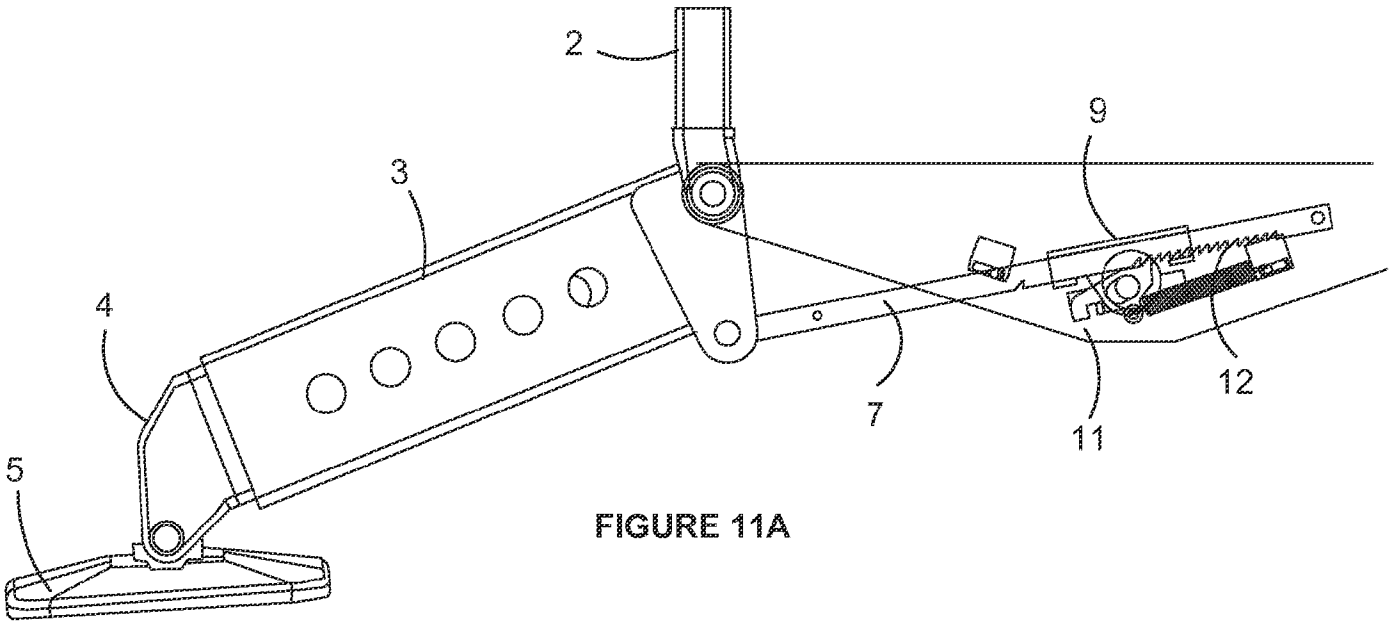
Figure 11B:
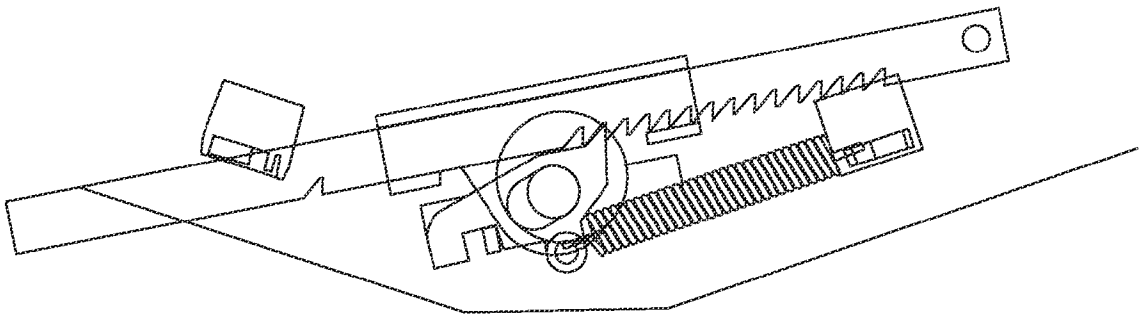

FIGS. 11A-11B/12 shows an alternative embodiment of the levelling stabilizer adjustment arm.

LEGEND

1. Transverse brace
2. Lower stiles
3. Leg portions
4. Telescopic extension
5. Pivotal foot
6. First pivot
7. Adjustment arm
8. Second pivot
9. Adjustment housing
10. Thumb screw
11. Captive pivot nut/pawl
12. Threaded/ratchet portion
13. Non-threaded portion
14. Receiving bush
15. Bush pivot
16. Arm stop
17. Interference member
18. Visual indicator

19. Retraction lock
20. Intermediate bracket
21. Lock body
22. Latch
23. Key regions
24. Offset cam Referring firstly to FIGS. 1 and 2 the levelling stabilizer of the invention can be seen to provide a highly versatile mechanism adapted for retrofitting to the bottom of the lower stiles 2 of an existing ladder or alternatively incorporated into the manufacture of a ladder in the first instance.

Figure 1:
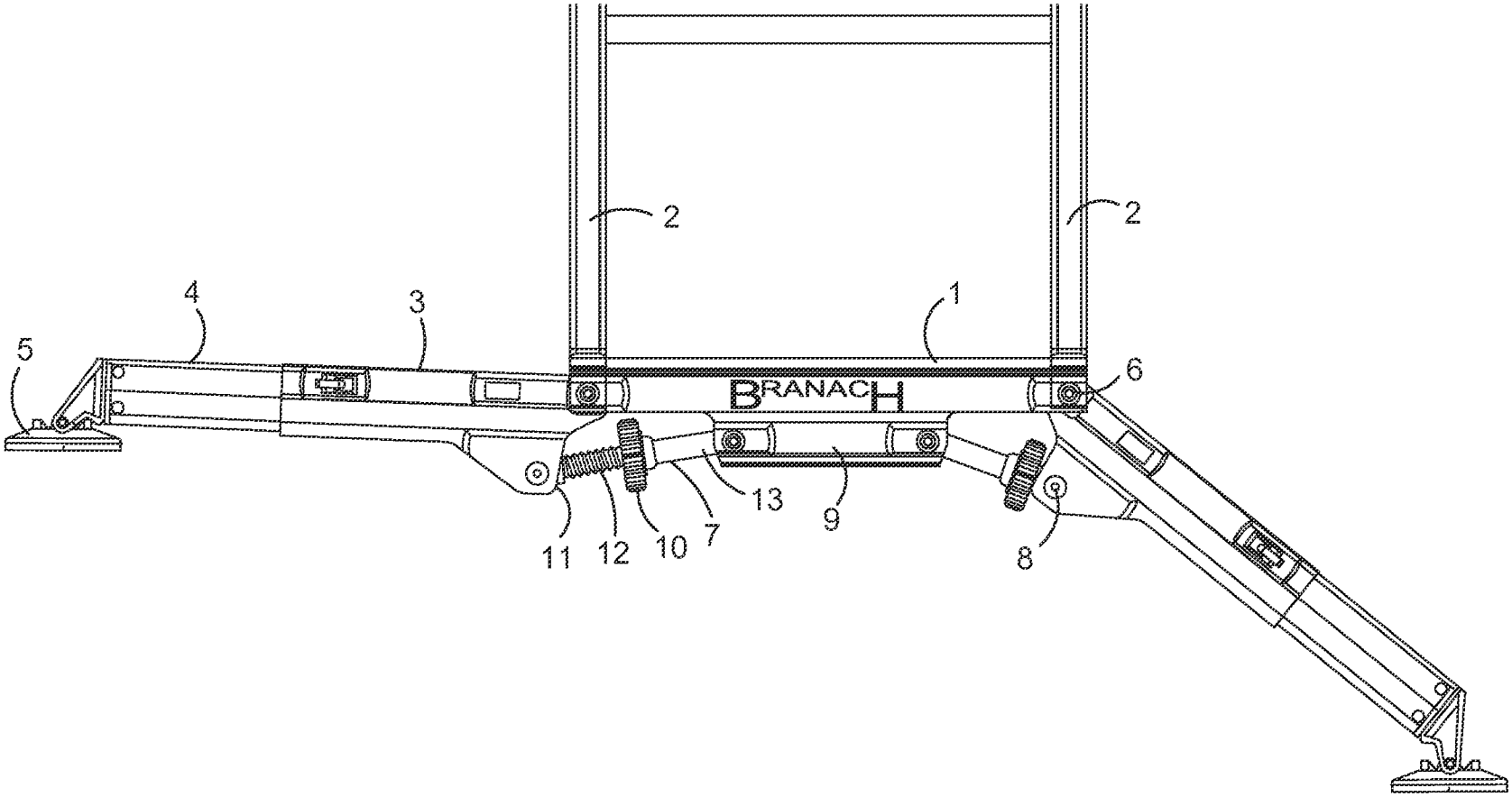
FIG. 1 shows a front view of the levelling stabilizer with one leg fully extended and one leg partially extended.
Figure 2:
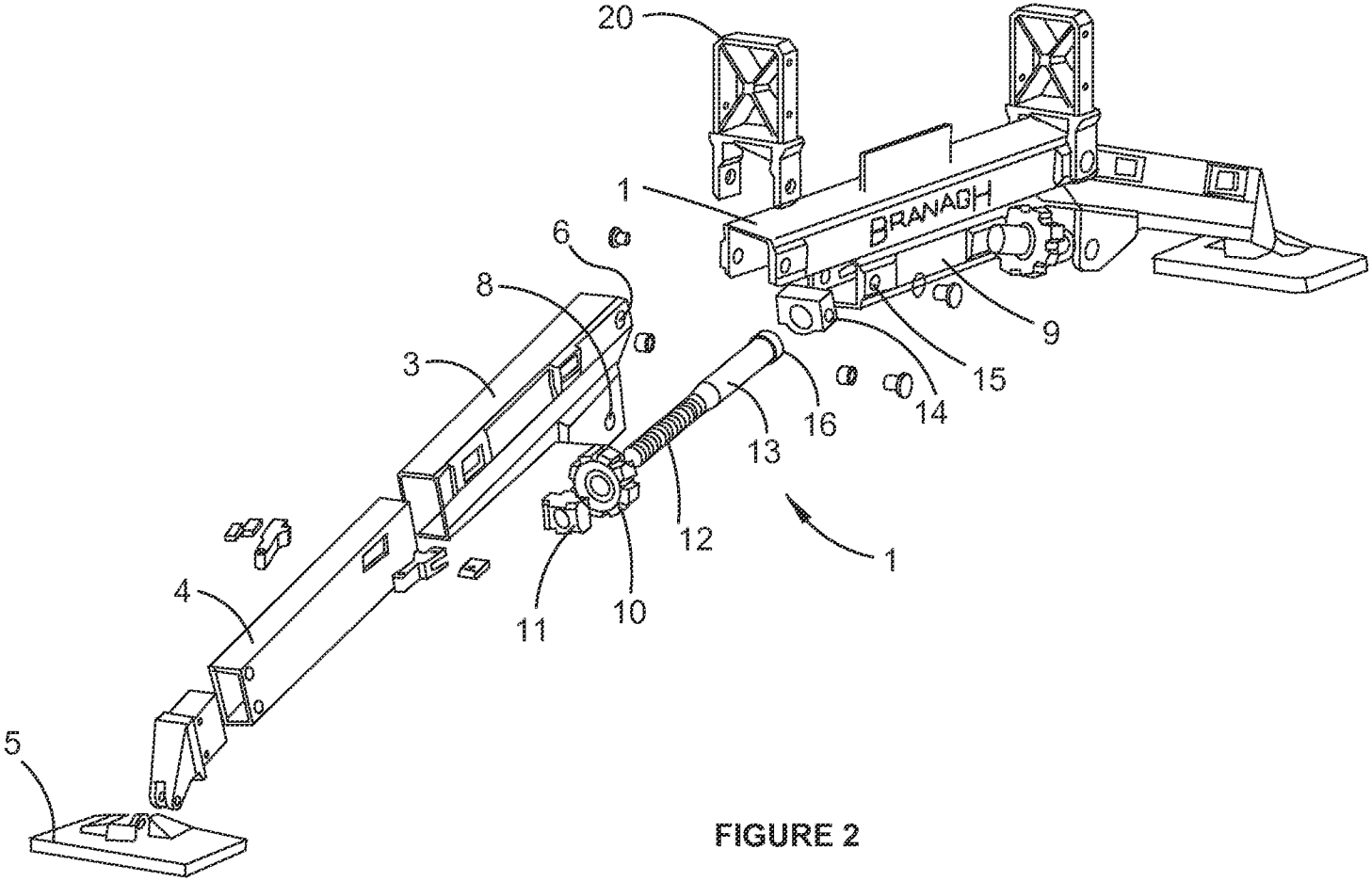
FIG. 2 shows an exploded view of one side of the levelling stabilizer.

The levelling stabilizer as shown in FIG. 1 gives a front view of the exaggerated variation available by independent adjustments of the leg portions 3 thereby allowing the levelling function of the device to adapt to a wide range of terrain on which the ladder can be safely positioned. In addition, the wide splaying affect of the extended legs can be seen to substantially increase the footprint available for the ladder which in the case demonstrated in the current example can multiply the footprint between three to four fold.

The levelling stabilizer of the invention comprises a first element in the form a transverse brace 1, the transverse brace is specifically dimensioned for fitting to the lower end of the lower stiles 2 of an extension ladder, the fitting of the transverse brace to the lower stiles can be affected by any convenient means, either direct incorporation during manufacture or alternatively for retro fitting can be directly bolted or can be bolted with the assistance of an intermediate bracket 20. The transverse brace provides a foundation for the mounting and incorporation of the further components of the levelling stabilizer and also serves to reinforce the end of the lower stiles so as to provide a robust foundation for the levelling stabilizer of the invention. The levelling stabilizer then incorporates two leg portions 3 which are pivotally fitted to the transverse brace 1 by way of a first pivot 6. Each leg portion may further include a telescopic extension 4 with the telescopic extension terminating in a pivotal foot 5. The telescopic extensions allow independent extension of each leg and the pivotal foot accommodates a variety of terrain and ensures stability of the levelling stabilizer on the available terrain.

Figure 5:
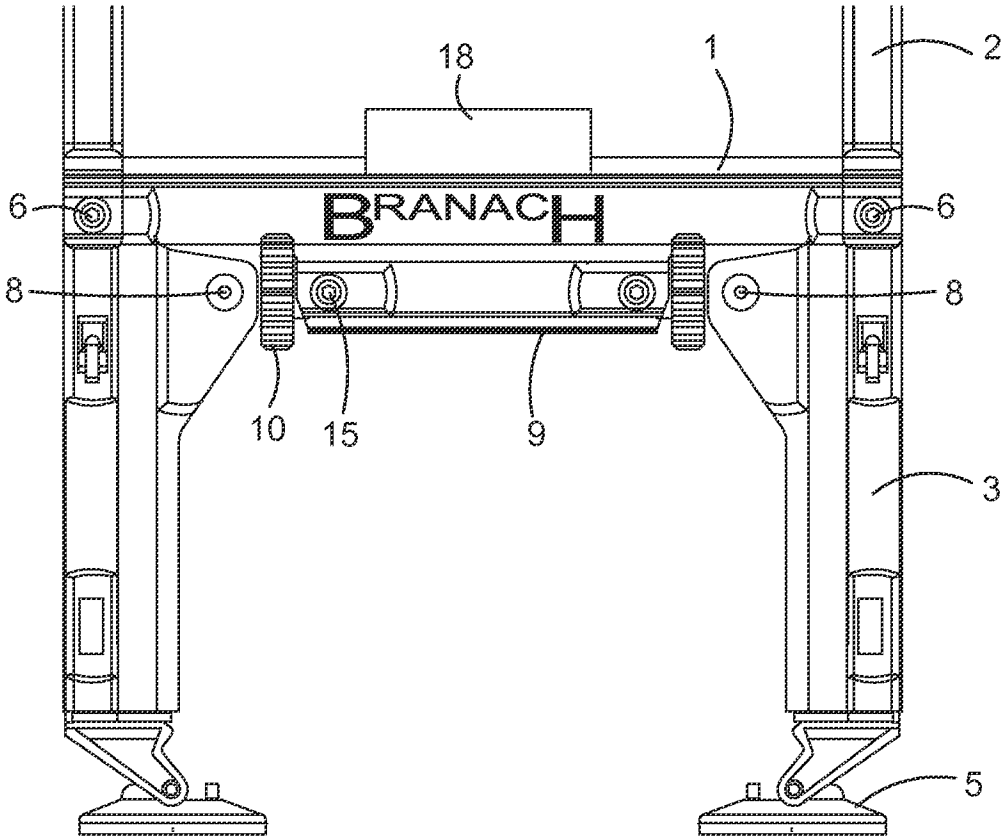
FIG. 5 shows a front view of the retracted levelling stabilizer fitted to a ladder.

The leg portions 3 are adapted to pivot between a first fully retracted position with the leg portions longitudinally aligned with the corresponding lower stile as best shown in FIG. 5 and a second fully extended position with the leg portion projecting outwardly from the lower stiles at an angle normal to the stile as shown in FIG. 1 with one of the legs being fully extended at an angle normal to the stile and the second leg being partially extended relative to the stile.

The control and adjustment of the legs relative to the transverse brace and accordingly relative to the ladder is provided by an adjustment arm 7 which acts between the transverse brace 1 and the relevant leg portion 3. The adjustment arm is most preferably formed as an elongate rod having a threaded portion 12 at one end and a non-threaded portion 13 at the other end. Intermediate between the treaded portion and the non-treaded portion is positioned a thumb screw 10 which is particularly adapted to be secured into the interface between the treaded portion and the non-threaded portion so as to provide a means of rotation of the adjustment arm around the axis thereof.

The adjustment arm is designed to provide adjustment by way of resistance to the movement of the leg portion 3 toward the second extended position whereby the leg is first moved from the fully retracted position to the partially extended position with the non-threaded portion of the adjustment arm sliding out of the transverse brace and most particularly sliding out of an adjustment portion housing 9 of the transverse brace which is incorporated beneath or subtending from the transverse brace. The partial extension of the leg be way of the free telescopic movement of the non-threaded portion is controlled by the non-threaded portion telescopically co-operating with a bush pivot 14 pivotably fitted at 15 to the adjustment housing 9. The non-threaded portion terminates in an arm stop 16 so the leg can be moved or opened from a fully retracted position to the first extended position by rotation about the first pivot 6 and telescopic withdrawal of the non-threaded portion of the adjustment arm through the bush pivot 14 until the telescopic movement is stopped with arm stop 16 abutting the bush pivot 14. At this stage as detailed in the partially extended leg of FIG. 1 the threaded portion of the adjustment arm 7 is fully wound into a corresponding captive pivot nut 11 positioned at a second pivot 8 on the leg portion 3.

When further extension of the leg portion 3 is required the adjustment arm 3 is rotated with the assistance of the thumb screw 10 thereby extending the reach of the leg portion 3 against the load bearing weight of the ladder which prevents the withdrawal of the non-threaded portion against the bush pivot 14. In this way the adjustment of the levelling stabilizer is effectively a one way adjustment with the rotation of the threaded portion affective to pivot the leg portion against the load bearing weight of the ladder. The availability of free telescopic movement of the non-threaded portion back into the bush pivot 14 allows the user to lift the ladder by relieving the load thereby freeing up the rotation of the adjustment arm to allow ready and easy adjustment. Once the adjustment is affected the return of the ladder to the load bearing position automatically extends the non-threaded portion to abut the arm stop against the bush pivot thereby using the threaded portion to fix the relative adjustment.

Figure 3:
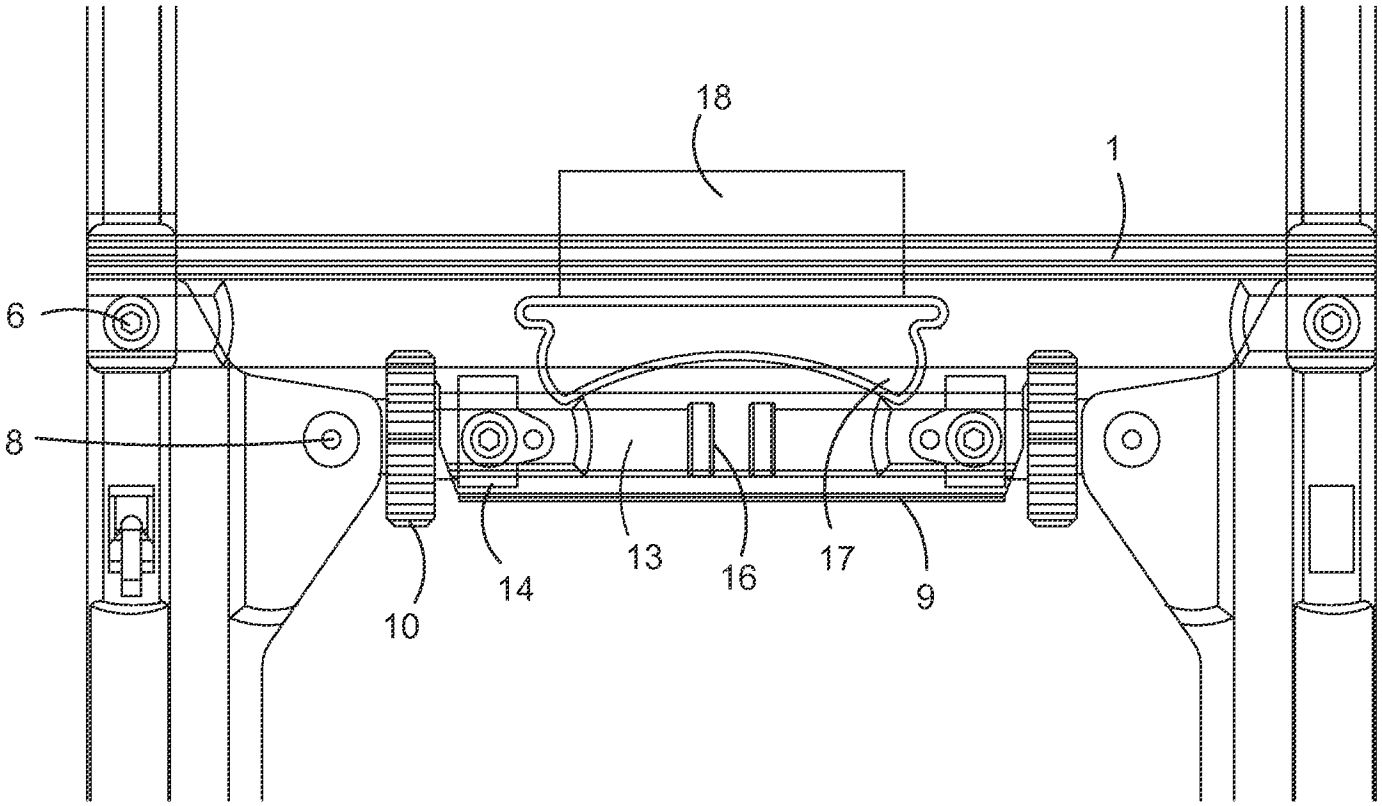
FIG. 3 shows a cross-section view of the levelling stabilizer with both legs in the fully retracted position with visual indication of same.
Figure 4:
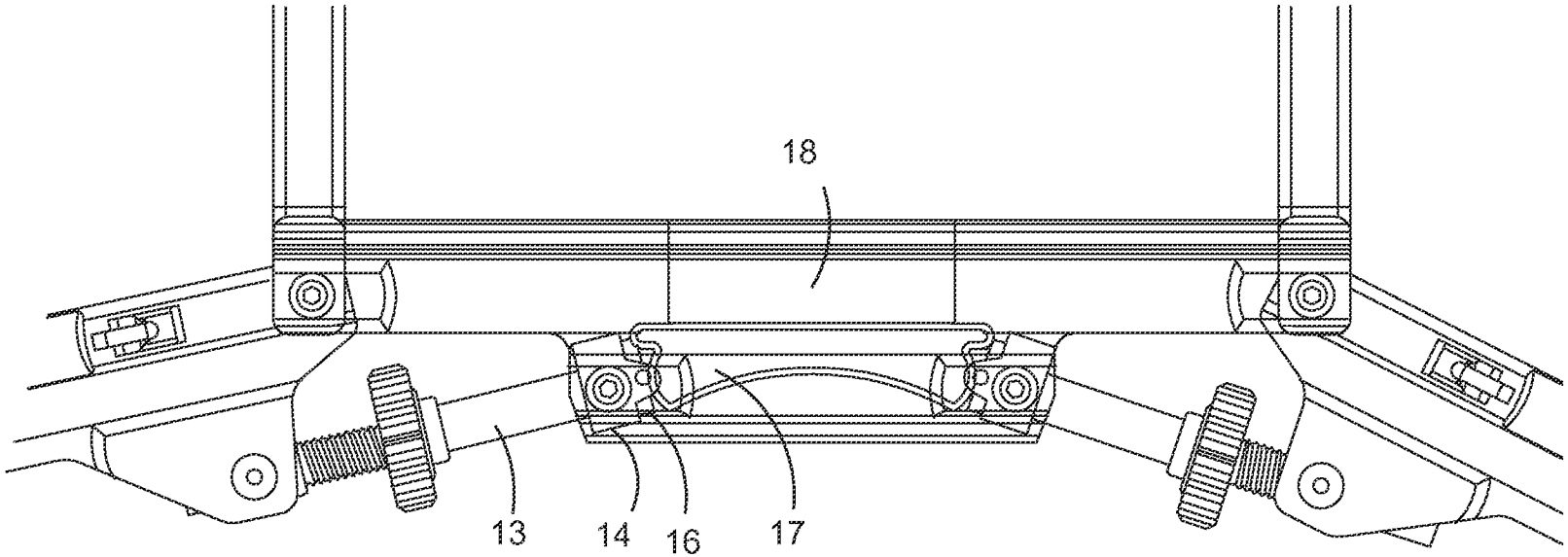
FIG. 4 shows a cross-section of the levelling stabilizer with both legs partially extended to different degrees and visual indication of readiness for load bearing.

Referring now to FIGS. 3 and 4 the adjustment housing portion 9 of the transverse brace 1 may include a floating interference member 17 which is adapted to freely move within the confines of the adjustment housing between a first raised position lifted up against the inside of the transverse brace as shown in FIG. 3 such that the interference member allows clearance of the non-threaded portion 13 of the adjustment arm 7 when in the fully retracted position with the legs 3 being fully retracted in the first position.

The interference member preferably includes a visual indictor 18 in the form of a brightly coloured or otherwise visual indicia applied thereto such that in the position with the leg portion being fully retracted a clear visual indication is provided to the user that the ladder is not ready for use or load bearing as the intention of the levelling stabilizer is not to provide increased vertical height to the ladder but to provide increased stability by increasing the footprint and/or levelling the leg portions in the extended position.

Figure 10A:
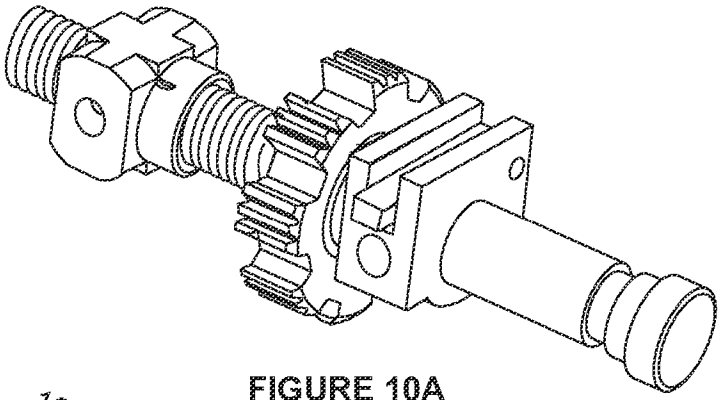
Figure 10B:
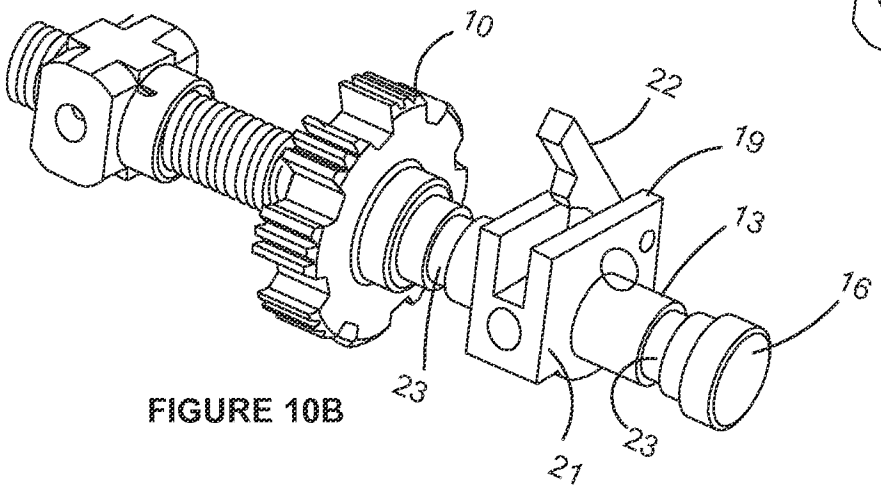
Figure 10C:
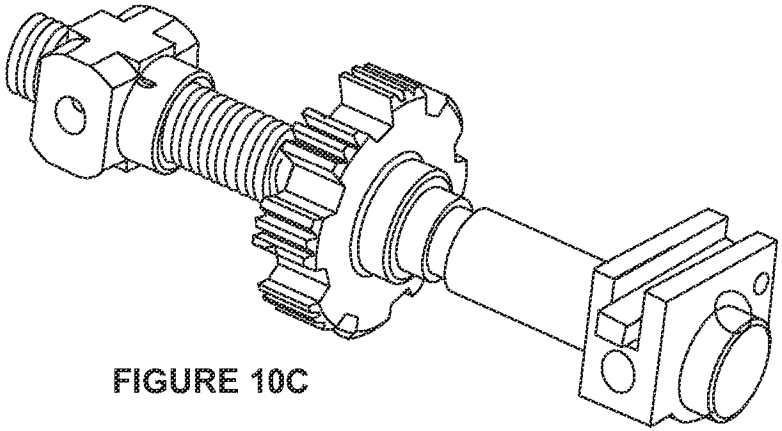

In order to provide security and ensure that the leg portions 3 do not inadvertently splay open to the first extended position due to inadvertent or unintended use in the fully retracted position the transverse brace and/or adjustment housing can be provided with a retraction lock 19 as shown in FIGS. 9 and 10 adapted to co-operate with the adjustment arm stop 16 so as to ensure that even in the event of inappropriate use the leg portions do not unintentionally splay out if used in the fully retracted position.

FIG. 4 shows the levelling stabilizer in normal use when the leg portions 3 are drawn out to the second extended position by telescopic sliding of the non-threaded portion 13 through the bush pivot 14 to the stop point with the stop 16 abutting the bush pivot. The interference member 17 is adapted to drop down to a second lowered position so as to intercept the adjustment arm stop 16 and prevent the unintended return to the fully retracted position except by way of the deliberate raising of the interference member so as to accommodate the return of the legs to the fully retracted position. A further feature of this facility allows the user to lift the ladder up for repositioning without the legs returning to the retracted position under gravity. The visual indicator 18 therefore provides a clear and apparent indication of the status of the ladder with the presence of the visual indicator showing the raised position of the interference member and hence clearly indicating that the ladder is not ready for load bearing or use until the leg portions are extended and hence ready to accommodate load bearing.

FIG. 5 shows the fully retracted position of the levelling stabilizer with the legs being aligned with the stiles 2 of the ladder so as to maximise the compact and transportable nature of the levelling stabilizer. In this position as previously described the ladder is not intended to be used as the full load bearing facility of the stabilizer is not in effect. However in order to ensure against the inadvertent use of the ladder in this position which can otherwise result in the free splaying or opening of the legs 3 to the first retracted position as shown in FIG. 6 the interference member and retraction lock ensure that the ladder can be used safely even in this position.

Figure 6:
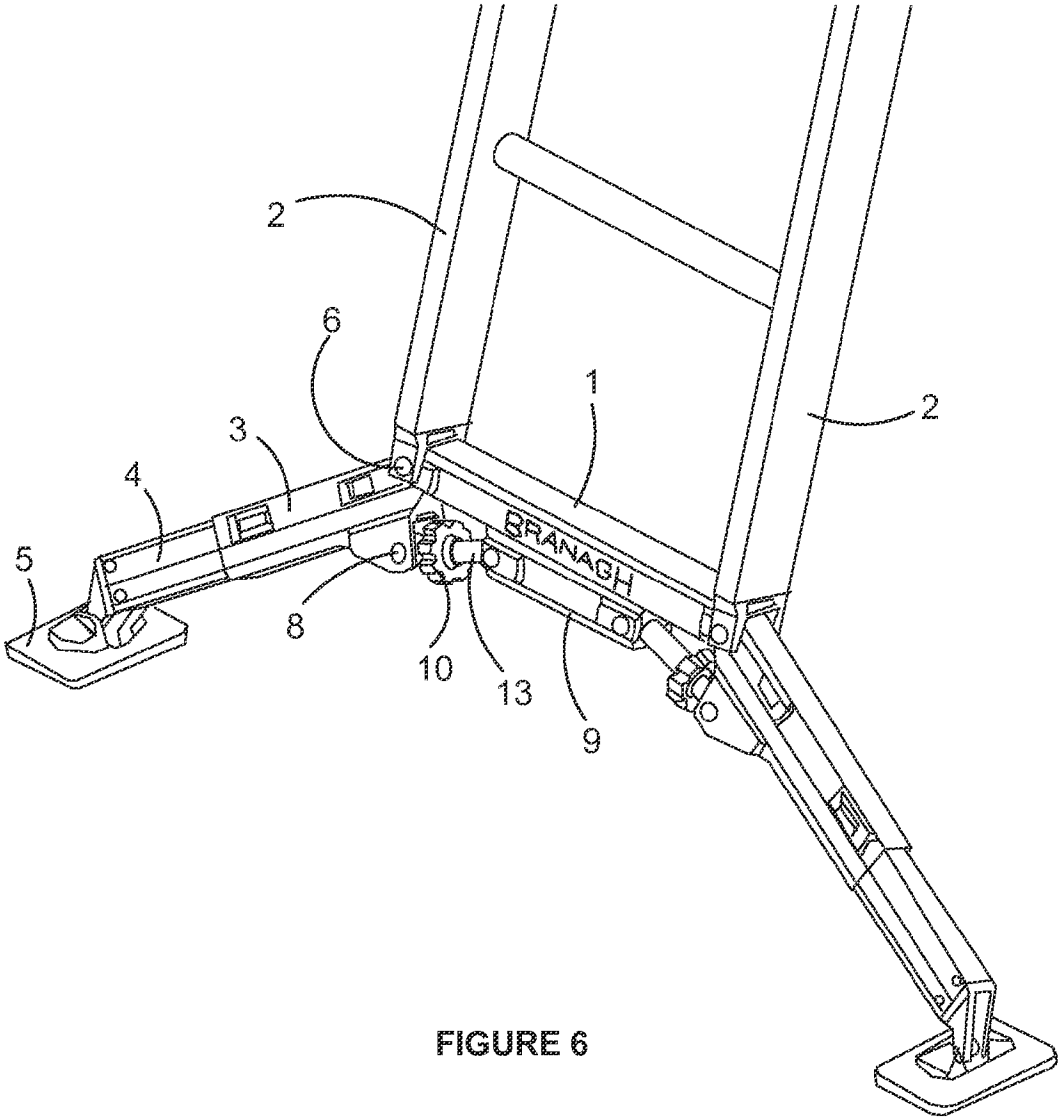
FIG. 6 shows a perspective view of the extended view of the extended levelling stabilizer fitted to a ladder.

FIG. 6 shows the first extended position of the legs which by lifting the interference member the legs can be rotated or opened to the first extended position by the telescopic withdrawal of the non-threaded portion of the adjustment arm 7 to the receiving bush 14. At this stage, the thumb screw 10 is fully wound up and provides the minimum extension allowable for the legs which are then fully load bearing with any load being weighted down on the legs thereby inducing rotation of the legs around a first pivot 6 thereby drawing the non-threaded portion 13 and arm stop 16 against the receiving bush 14. If further extension or adjustment of the leg 3 is required the load can be lifted from the ladder thereby allowing free rotation of the thumb screw 10 so as to wind out the threaded portion 12 of the adjustment arm 7 thereby further splaying the leg 3 as the threaded portion 12 winds through the captive pivoted mount 11 thereby rotating and further extending the leg 3 around the second pivot 8. Once the appropriate levelling and splaying is achieved any load applied to the ladder is automatically locked against the thread and full stability of the ladder is achieved. When the ladder is to be returned to the fully retracted position the load is withdrawn and the thumb screw wound back so as to return the leg to the first extended position and further full retraction of the leg is accomplished by lifting the interference member thereby allowing the non-threaded portion to return to the confines of the adjustment housing whereupon the retraction lock is activated so as to secure the arms in their retracted position while simultaneously raising the visual indicator to show the status of the ladder.

Figure 8:
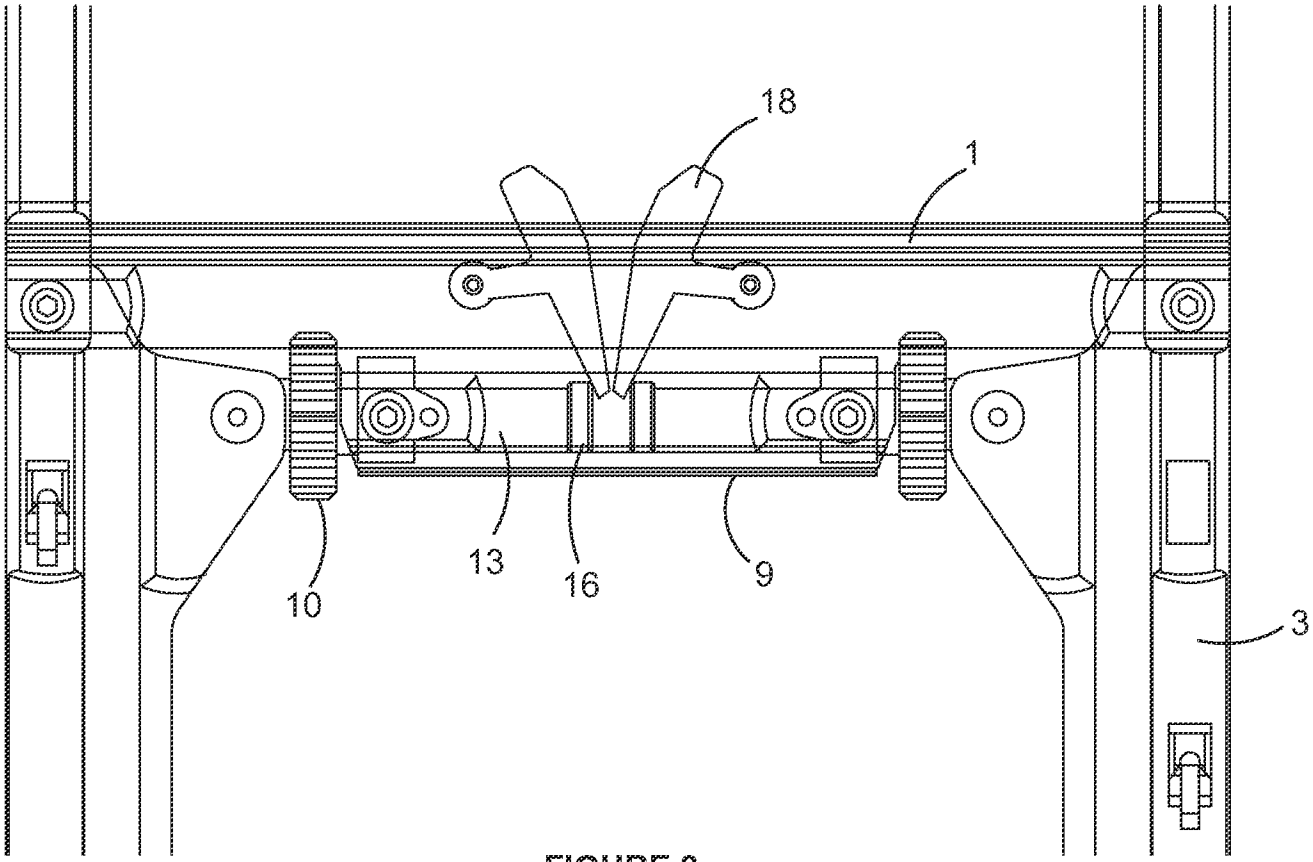

Referring now to FIGS. 7 and 8 an alternative embodiment of the visual indicator 18 is shown with the interference member 17 and visual indicator 18 being formed as a pair of pivoted arms able to rotate and pivot within the confines of the adjustment housing 9 about a pivot point positioned within the transverse brace 1. In this manner with the legs in the extended position as shown in FIG. 7 the interference member 17 is allowed to follow the arm stop 16 thereby lowering the visual indicator 18 to within the confines of the transverse brace so as to retract the visual indicator and show that the ladder is ready for load bearing.

As shown in FIG. 8 when the legs 3 are in the fully retracted position the arm stop 16 is drawn within the confines of the adjustment housing 9 so as to bear upon and rotate interference members 17 thereby projecting the visual indicator 18 outside the confines of the transverse brace so as to provide a clear visual indication that the ladder is not ready for load bearing use.

Referring now to FIG. 9 details of the retraction lock 19 are shown in one particular embodiment at three stages of operation with the retraction lock being formed of two semi-circular members pivotally mounted to the receiving bush 14 such that in the fully retracted position the retraction lock pivots down and rotates such that its semi-circular configuration abuts the non-threaded portion 13 of the adjustment housing 19 thereby engaging the arm stop 16 and preventing the legs from being moved to the extended position without the intentional movement of the retraction lock to be lifted up as shown in stage 2 so as to allow withdrawal of the adjustment arm during rotation of the legs 3 to the extended position. A further feature of this embodiment of the retraction lock includes its ability to function as the previously described interference member by capturing the arm stop 16 when it reaches the receiving bush and prevent the retraction of the legs without active raising to allow the adjustment arm to return into the adjustment housing as shown in stage 3.

An alternative embodiment of the retraction lock is shown in FIG. 10 with a lock comprising a lock body 21 and a pivoting latch 22 where the lock body is adapted to move in an axial direction along the non-threaded portion 13 of the adjustment arm and where the latch 22 is adapted to engage key regions 23 formed at either end of the non-threaded portion 13.

In a further embodiment of the invention an alternative configuration for the adjustment arm 7 is shown where FIG. 11 provides the adjustment arm as a elongate member having a ratchet portion 12 adapted to co-operate with a captive pawl 11 fitted to the adjustment housing 9. In this manner the adjustment arm can provide a discrete range of adjustments for the leg 3 by interaction with the ratchet and pawl as the leg is moved from the retracted to the extended position.

Figure 12:
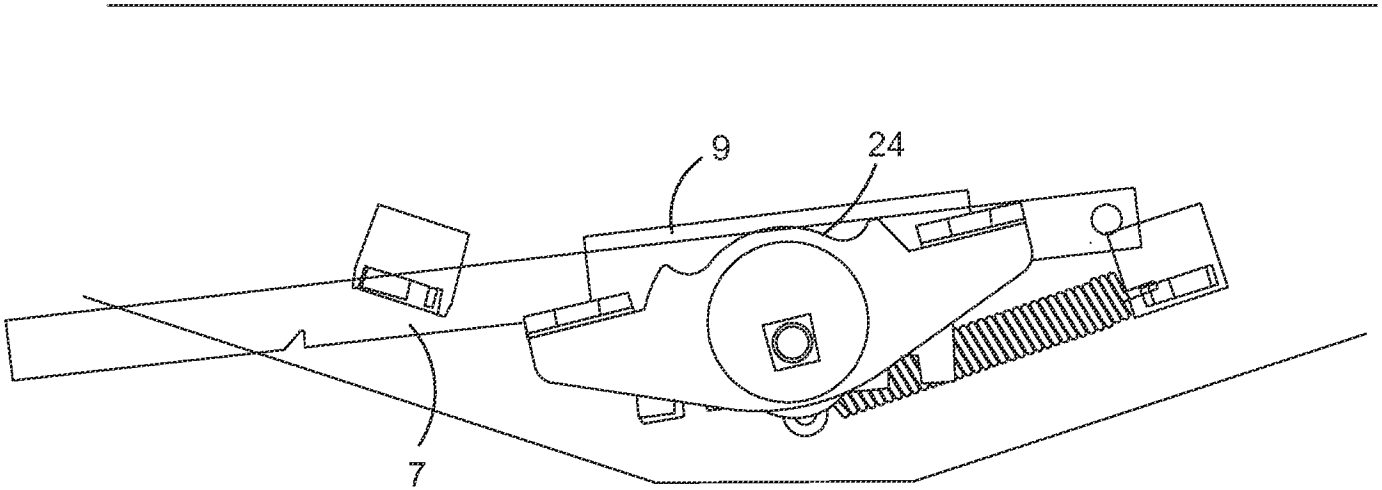

FIG. 12 shows details of a fine tuning facility associated with the adjustment arm comprising an offset cam 24 adapted to co-operate with the adjustment housing 9 so as to provide fine tuning of the leg extension.

The invention claimed is:

1. A levelling stabilizer for a ladder having a pair of spaced apart stiles, the stabilizer comprising a transverse brace adapted for bridging a lower portion of each of the stiles of the ladder, two legs pivotally fitted to the brace and a pair of adjustment arms acting between the brace and each of the legs respectively, to allow each of the legs to be independently moved relative to the brace between a first fully retracted position aligned longitudinally with the stiles of the ladder and a second fully extended position at an angle normal to the stiles of the ladder, wherein each adjustment arm is disposed between the transverse brace and the respective leg such that the adjustment arm is loaded in tension.

2. A levelling stabilizer according to claim 1, wherein each adjustment arm is rotatable and comprises a threaded portion co-operating with one of the two legs such that the adjustment arms resist movement of the respective leg when in the second extended position except by rotation of said threaded portion.

3. A levelling stabilizer according to claim 1, wherein each adjustment arm comprises a non-threaded portion providing a stop, wherein the non-threaded portion co-operates with the transverse brace allowing movement of the respective leg between the first retracted and second extended positions with the stop limiting the extension of the leg in the second position.

4. A levelling stabilizer according to claim 1, wherein each adjustment arm comprises a thumb screw to assist in rotation of the adjustment arm to affect the adjustment.

5. A levelling stabilizer according to claim 3, wherein the transverse brace comprises an adjustment housing subtending therefrom.

6. A levelling stabilizer according to claim 5, wherein the adjustment housing comprises a pivoting receiving bush co-operating with the non-threaded portion of the adjustment arms.

7. A levelling stabilizer accordingly to claim 6, wherein the stop co-operates with the receiving bush to limit the available extension.

8. A levelling stabilizer according to claim 2, wherein each of the legs comprise a pivoting captive nut co-operating with the threaded portion of each adjustment arm, respectively.

9. A levelling stabilizer according to claim 5, comprising an interference member positioned within the adjustment housing and being freely movable therein between a first raised position accommodating the non-threaded portion of the adjustment arms during the retracted leg position and a second forward position intercepting the adjustment arms stops during the extended leg position and preventing retraction of the legs.

10. A levelling stabilizer according to claim 9, wherein the interference member comprises a visual indicator of the first and second positions.

11. A levelling stabilizer according to claim 3, comprising a retraction lock retaining the legs in the retracted position.

12. A levelling stabilizer according to claim 11, wherein the retraction lock co-operates with the stop of the non-threaded portion of the adjustment arm to retain the leg in the retracted position.

13. A levelling stabilizer according to claim 1, wherein each of the legs is configured to independently move relative to the brace.

14. A levelling stabilizer according to claim 1, wherein each of the legs is pivotally attached to the transverse brace at a pivot point and each of the adjustment arms is attached to the respective leg between the pivot point and a distal end of the respective leg.

* * * * *